United States Patent [19]

Jentsch et al.

[11] Patent Number: 4,988,039

[45] Date of Patent: Jan. 29, 1991

[54] NEWSPAPER BASKET

[76] Inventors: Christopher A. Jentsch, 37 Choate Ave., Buffalo, N.Y. 14220; George Spector, 233 Broadway #3815, New York, N.Y. 10007

[21] Appl. No.: 391,977

[22] Filed: Aug. 10, 1989

[51] Int. Cl.[5] ..... A47F 5/00

[52] U.S. Cl. ..... 232/1 C; 211/88; 211/175

[58] Field of Search ..... 232/1 C, 19, 20, 22; 211/88, 106, 175

[56] References Cited

U.S. PATENT DOCUMENTS

| | | | |
|---|---|---|---|
| 856,593 | 6/1907 | Lee | 211/88 |
| 1,921,889 | 8/1933 | Shelton | 232/1 C |
| 2,207,369 | 7/1940 | Baty | 211/88 |
| 2,616,618 | 11/1952 | Zurawski | 232/1 C |
| 3,747,776 | 7/1973 | Gross | 211/88 X |
| 4,040,522 | 8/1977 | Vickery | 211/88 |
| 4,146,138 | 3/1979 | Davis | 211/106 X |
| 4,746,062 | 5/1988 | Bartylla | 232/1 C |
| 4,801,081 | 1/1989 | O'Connor | 232/1 C |

*Primary Examiner*—Robert W. Gibson, Jr.

[57] ABSTRACT

A newspaper holder is provided and consists of a housing body having an open top for receiving a newspaper deposited therein. The housing body is mounted to an exterior surface of an entry door so that it will be between a screen/storm door and the entry door. The newspaper holder can be adjusted to accommodate various sized newspapers.

1 Claim, 1 Drawing Sheet

NEWSPAPER BASKET

BACKGROUND OF THE INVENTION

The instant invention relates generally to newspaper receiving devices and more specifically it relates to a newspaper holder.

Numerous newspaper receiving devices have been provided in prior art that are adapted to keep newspapers in secure retained conditions on or near doors. For example, Shelton U.S. Pat. No. 1,921,889; Dupuis U.S. Pat. No. 4,494,690 and Bartylla U.S. Pat. No. 4,746,062 all are illustrative of such prior art. While these units may be suitable for the particular purpose to which they address, they would not be as suitable for the purposes of the present invention as heretofore described.

SUMMARY OF THE INVENTION

A primary object of the present invention is to provide a newspaper holder that will overcome the shortcomings of the prior art devices.

Another object is to provide a newspaper holder than can be attached to the exterior surface of an entry door between a screen/storm door and the entry door.

An additional object is to provide a newspaper holder that can be adjusted after being attached to the exterior surface of the entry door so as to accommodate various sizes of newspaper therein.

A further object is to provide a newspaper holder that is simple and easy to use.

A still further object is to provide a newspaper holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 2:
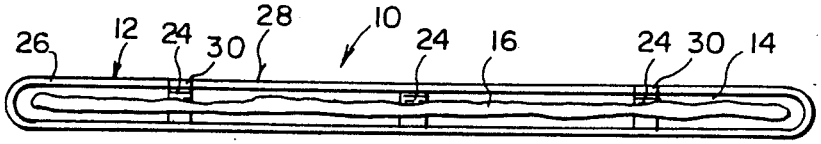
FIG. 2 is a top view of the invention.
Figure 1:
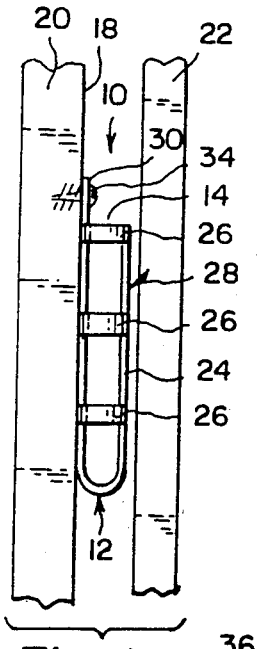
FIG. 1 is a side view of the invention mounted to an entry door behind a screen storm door.
Figure 3:
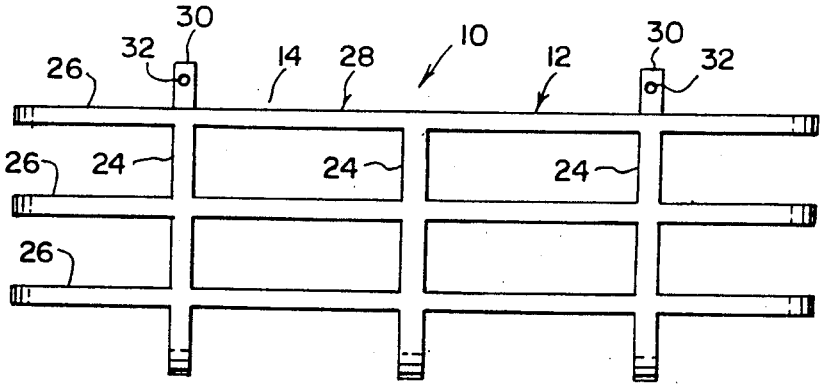
FIG. 3 is a front view of the invention.

Turning now descriptively to the drawings, in which similar reference characters denote similar elements throughout the several views, FIGS. 1, 2 and 3 illustrate a newspaper holder 10 consisting of a housing body 12 having an open top 14 for receiving a newspaper 16 deposited therein. The housing body 12 is mounted to an exterior surface 18 of an entry door 20 so that the housing body 12 will be between a screen/storm door 22 and the entry door 20.

The housing body 12 includes a plurality of spaced apart vertical U-shaped bands 24. A plurality of spaced apart horizontal oval-shaped bands 26, are also provided, which are interconnected to the vertical bands 24 to form a basket 28, so that the newspaper 16 cab be seen when deposited therein.

At least two of the vertical bands 24, each have an extended rear leg 30 with an aperture 32 therethrough for receiving a fastener 34, such as a screw which extends into the exterior surface 18 of the entry door 20. The horizontal bands 26 and the vertical bands 24 are integral with each other so that the basket 28 is formed as one unit.

Figure 4:
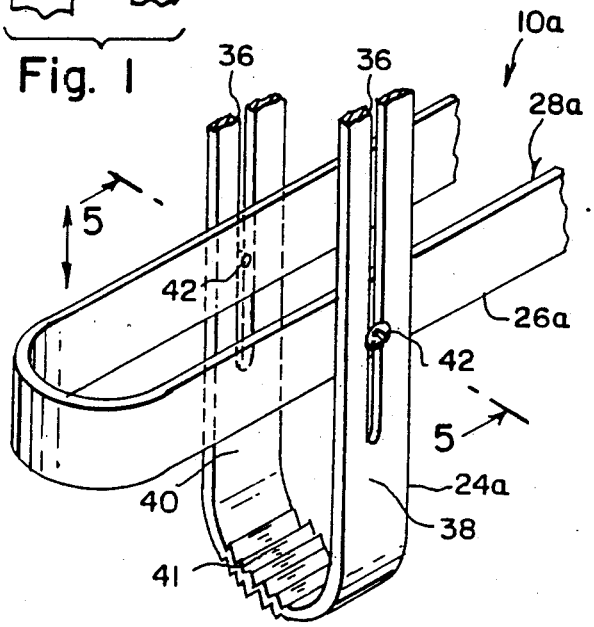
FIG. 4 is a perspective view of a modification showing the horizontal band as being height adjustable relative to the vertical band which has an accordion bottom portion to expand for various sized newspapers.
Figure 5:
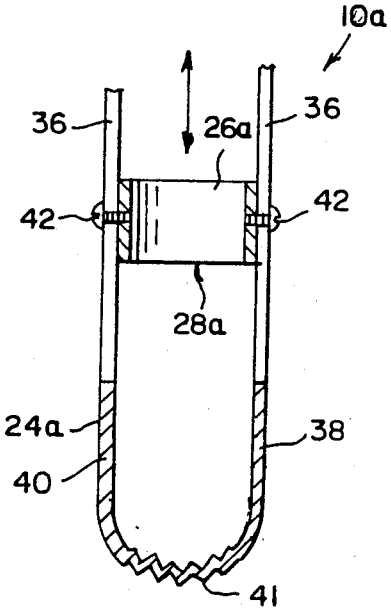
FIG. 5 is a cross sectional view taken along line 5—5 in FIG. 4, showing the slots and set screws in greater detail.

A modified newspaper holder **10*a* is shown in FIGS. 4 and 5 wherein the basket 28*a* further includes each of the vertical bands 24*a* having a longitudinal about 36 formed in front leg 38 and rear leg 40 and an accordion bottom portion 42. A set screw 44 is placed through each of the longitudinal slots 36 and is threaded into one of the horizontal bands 26*a*. The horizontal bands 26*a* can slide up and down while the accordion bottom portions 42 of the vertical band 24*a* can expand allowing the basket 28*a* to be adjustable to accommodate various sized newspapers 16** therein.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A newspaper holder which comprises:

a) a housing body having an open top for receiving a newspaper deposited therein; and b) means for mounting said housing body to an exterior surface of an entry door so that said housing body will be between a screen/storm door and the entry door, wherein said housing body includes:

c) a plurality of spaced apart vertical U-shaped bands; and d) a plurality of space apart horizontal oval-shaped bands interconnected to said vertical bands to form a basket so that the newspaper can be seen when deposited therein, wherein said mounting means includes at least two of said vertical bands each having an extended rear leg with an aperture therethrough for receiving a fastener which extends into the exterior surface of the entry door, wherein said horizontal and vertical bands are integral with each other so that said basket is formed as a one piece unit, wherein said basket further includes:

e) each of said vertical bands having a longitudinal slot formed in front and rear legs and an accordion bottom portion; and f) a plurality of set screws, each placed through one of said longitudinal slots and threaded into one of said horizontal bands so that said horizontal bands can slide up and down while said accordion bottom portions of said vertical bands can expand allowing said basket to be adjustable to accommodate various sized newspapers therein.

* * * * *